US006988750B2

(12) United States Patent
Bromhall

(10) Patent No.: US 6,988,750 B2
(45) Date of Patent: Jan. 24, 2006

(54) DOOR LATCH AND DOOR LATCH INSTALLATION METHOD

(75) Inventor: Adrian V. Bromhall, Wolverhampton (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 10/281,441

(22) Filed: Oct. 25, 2002

(65) Prior Publication Data

US 2003/0085578 A1 May 8, 2003

(30) Foreign Application Priority Data

Nov. 8, 2001 (GB) ..... 0126790

(51) Int. Cl.
*E05C 3/06* (2006.01)

(52) U.S. Cl. ..... 292/216; 292/DIG. 64

(58) Field of Classification Search ..... 292/216, 292/201, DIG. 23; 70/264
See application file for complete search history.

(56) References Cited

U.S. PATENT DOCUMENTS

| | | | | |
|---|---|---|---|---|
| 1,799,503 A | * | 4/1931 | Devereaux | |
| 3,608,941 A | * | 9/1971 | Kondo et al. | 292/280 |
| 4,671,548 A | * | 6/1987 | Haberle | 292/216 |
| 5,100,185 A | | 3/1992 | Menke et al. | |
| 5,906,123 A | * | 5/1999 | Spurr | 70/264 |
| 6,059,328 A | * | 5/2000 | Gomi | 292/216 |
| 6,141,914 A | * | 11/2000 | Feige | 49/503 |
| 6,149,210 A | * | 11/2000 | Hunt et al. | 292/216 |
| 6,213,523 B1 | * | 4/2001 | Magnusson | 292/165 |
| 6,234,548 B1 | * | 5/2001 | Mittelbach | 292/336.3 |
| 6,308,998 B1 | | 10/2001 | Armbruster et al. | |
| 6,530,251 B1 | * | 3/2003 | Dimig | 70/237 |

FOREIGN PATENT DOCUMENTS

| | | |
|---|---|---|
| DE | 198 40 464 A1 | 3/2000 |
| EP | 1 046 772 | 10/2000 |
| EP | 1 110 775 | 6/2001 |
| FR | 2 778 195 | 11/1999 |
| GB | 2 156 422 A | 10/1985 |
| GB | 2 343 218 A | 5/2000 |
| GB | 2 344 135 A | 5/2000 |

OTHER PUBLICATIONS

Patents Act 1977, Search Report under Section 17 Date of Search: Mar. 25, 2002.
European Search Report dated Oct. 21, 2004.

* cited by examiner

*Primary Examiner*—Gary Estremsky
(74) *Attorney, Agent, or Firm*—Carlson, Gaskey Olds

(57) ABSTRACT

A door latch for a vehicle door comprising a first lever for the transmission of a first input to the latch from a first input source and a second lever for the transmission of a second input to the latch from a second input source, wherein the first lever is capable of retaining the second lever in a retracted position when the first lever is in a rest position, but when the first lever is in an actuated position, enables the second lever to move to a deployed position at which the second lever may transmit the second input from the second input source.

10 Claims, 4 Drawing Sheets

DOOR LATCH AND DOOR LATCH INSTALLATION METHOD

This application claims priority from United Kingdom (GB) Patent Application No. 0126790.5 filed on 8 Nov. 2001.

The present invention relates to a door latch and to a method of installing a door latch. More particularly, the present invention relates to a door latch for a vehicle door and a method of installing a door latch in a vehicle door.

It is becoming increasingly prevalent to fit a number of door components such as latches, window regulators, and speakers to a door subassembly commonly known as a door module. This enables the subassembly to be assembled away from the vehicle assembly line, and can therefore minimize the overall assembly time of a vehicle by enabling the module to be fitted to the door as a single item on the assembly line.

Doors are generally assembled from the outside face in. This means that the door outside release handle and key barrel must normally be fitted to the outer door skin prior to the fitting of the door module. Additionally, once the door module is fitted, it is difficult to access the void between the door module and the door outer skin to manually connect the inside release handle and key barrel to their respective linkages that transmit inputs therefrom to the latch. Furthermore, it is undesirable to attempt to connect these linkages whilst installing the door module since the process can be fiddly and the overall assembly time is therefore increased. The linkages may also foul on other door fittings during fitment of the door module if left unrestrained.

The present invention seeks to overcome, or at least mitigate, the aforesaid problems.

SUMMARY OF THE INVENTION

One aspect of the present invention provides a door latch for a vehicle door comprising a first lever for the transmission of a first input to the latch from first input means and a second lever for the transmission of a second input to the latch from second input means, wherein the first lever is capable of retaining the second lever in a retracted position when the first lever is in a rest position, but when the first lever is in an actuated position, enables the second lever to move to a deployed position at which the second lever may transmit the second input from the second input means.

BRIEF DESCRIPTION OF THE DRAWINGS

Embodiments of the present invention will now be described, by way of example only, with reference to the accompanying drawings in which.

DETAILED DESCRIPTION OF PREFERRED EMBODIMENT

Figure 1:
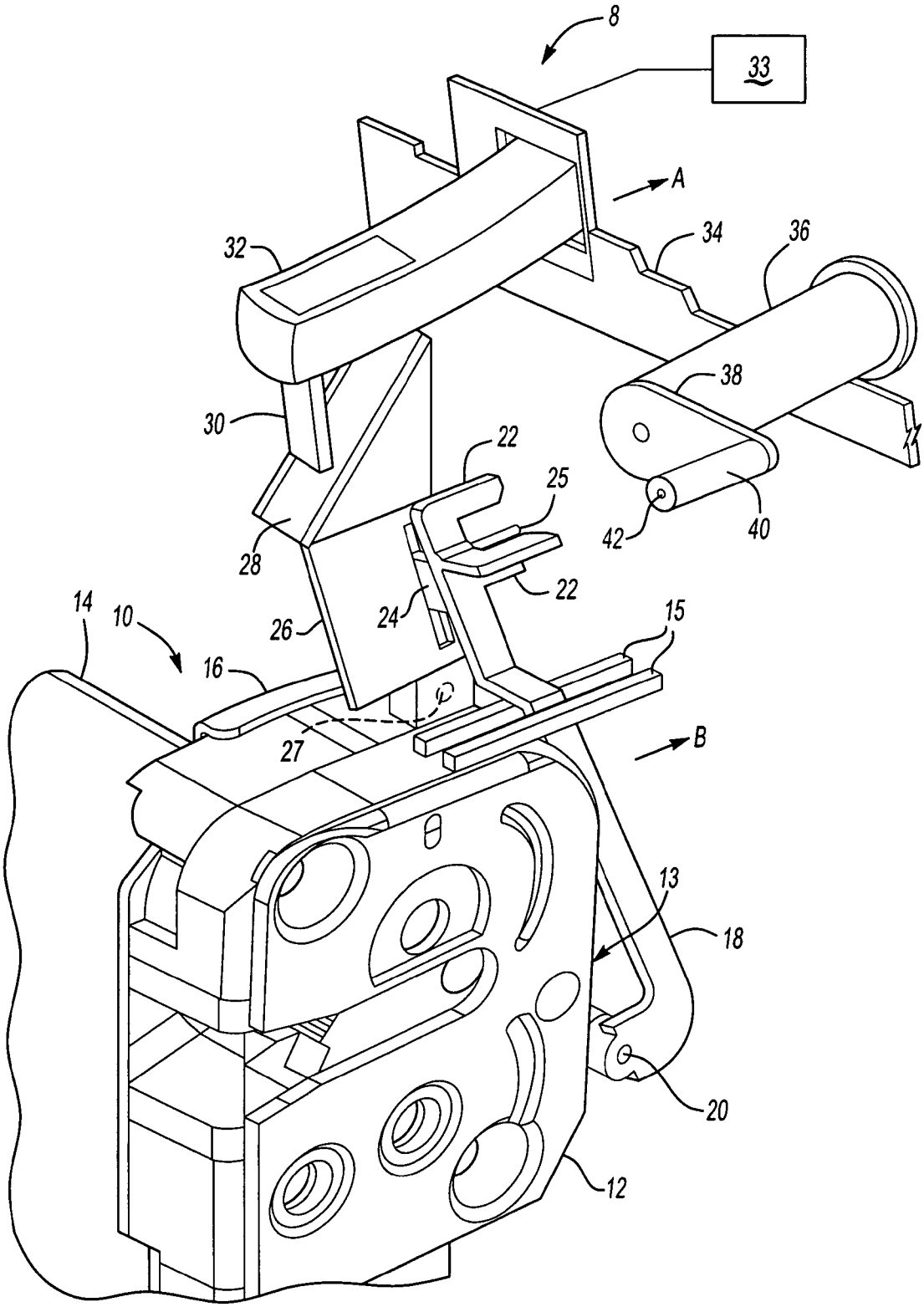
FIG. 1 is a perspective view of a portion of a door including a latch according to the present invention, showing a lever of the latch in a first position.

Referring to FIG. 1, there is shown a portion of a door 8 in which, for clarity, the majority of the door skin is not shown. A door module 10 is secured to the door by fasteners such as screws (not shown), for example. The module 10 comprises in this embodiment, a latch 12 and an intermediate panel 14 to which the latch is secured by a bracket 16.

The latch 12 is provided with a key lever 18 on latch housing 13, which when installed in the door is arranged to transmit inputs from key barrel 36 via key barrel output arm 38 and coupling 40 as described in greater detail below. A guide means in the form of a pair of parallel spaced guide bars 15, between which the key lever 18 is arranged, is preferably provided on the latch 12 to ensure that the key lever 18 deploys along the correct path as described below. The latch 12 further comprises an outside handle release lever or paddle 26 pivotally mounted at pivot 27 to the latch housing 13 and provided with an inclined ramp surface 28 arranged to be engaged by a finger 30 of an outside release handle linkage 32 from an outside release handle illustrated schematically at 33.

Considering the key lever in more detail, it can be seen that in FIG. 1 the key lever 18 is restrained in a retracted position due to lug 24 (of key lever 18) engaging with a projection 44 provided on outside release lever 26. The projection 44 is obscured in FIG. 1 but is visible in FIG. 2. Key lever 18 is rotatably mounted to the latch about pivot 20 and is resiliently biased in a clockwise direction (B) by suitable means such as a torsion spring (not shown). However, the movement of key lever 18 to lock and unlock the latch is substantially vertical.

Figure 3:
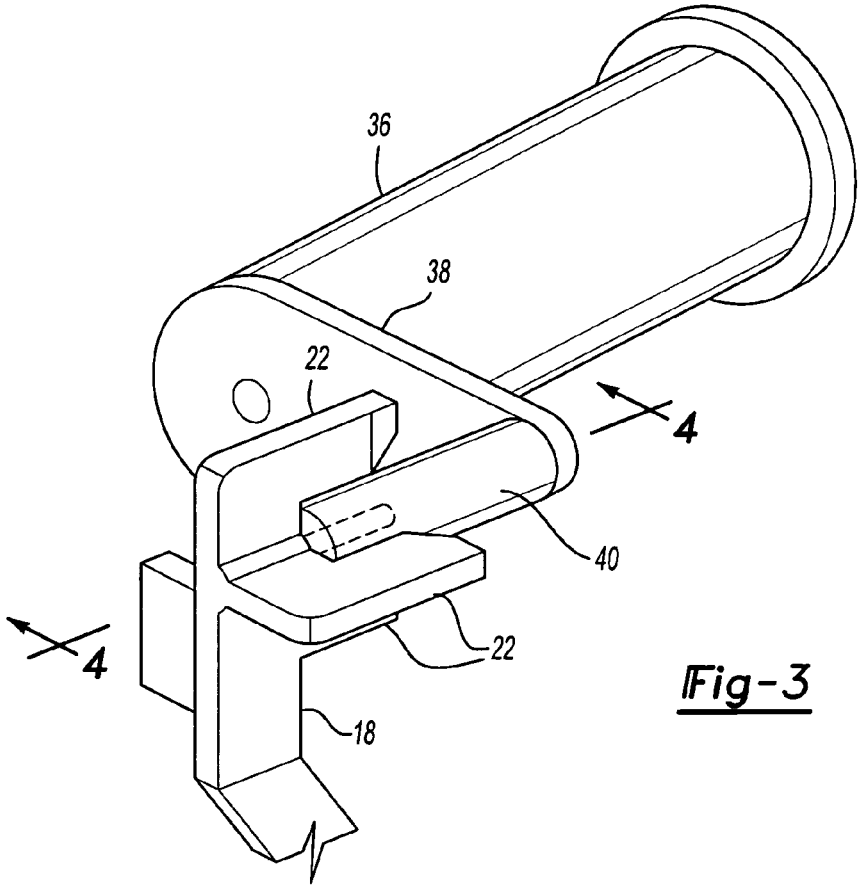
FIG. 3 is an enlarged perspective view of the portion F circled in FIG. 2.
Figure 4:
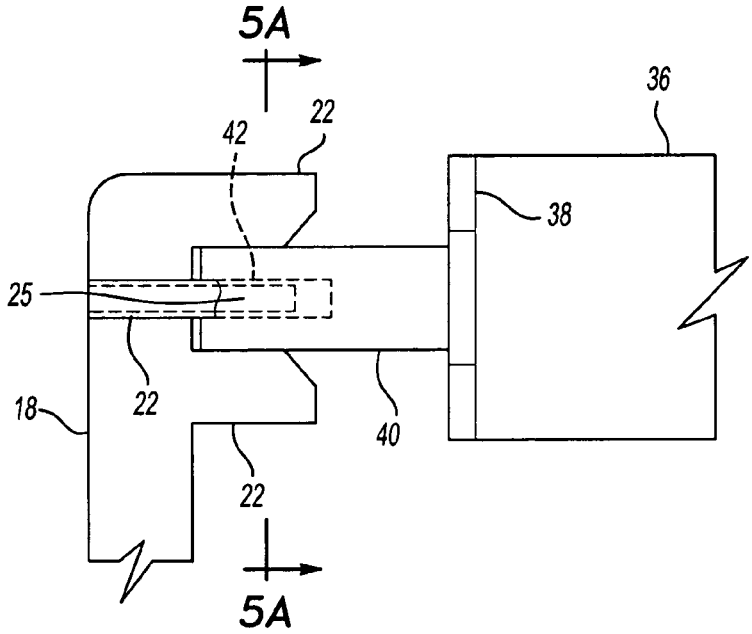
FIG. 4 is a cross section along the axis X—X of FIG. 3.

In order to engage the key barrel, a suitable formation is provided at the free end of the key lever 18. This can be seen most clearly in FIGS. 3 and 4, and this embodiment comprises three guide teeth 22 having appropriate mutual spacing to receive the coupling 40. To accommodate any tolerance errors in the positioning of the key lever 18 relative to the key barrel 36, the ends of each tooth 22 are preferably bevelled to guide the key lever 18 into engagement with the coupling 40. To provide positive engagement between the key lever 18 and the coupling 40, a projection 25 is preferably provided on the key lever 18 to engage in a central aperture 42 provided in the coupling 40.

During assembly (with the outside release handle linkage 32 and the key barrel 36, key barrel output arm 38 and coupling 40 in place), a door assembler offers the door module 10 up to the door 8 and secures the two assemblies together using suitable fasteners such as screws. During this installation, the key lever 18 is held in the restrained position shown in FIG. 1 behind projection 44. In this position, the risk of key lever 18 fouling on one of the door components is reduced. The installation process also causes the ramp surface 28 of release lever 26 to be positioned outside of finger 30.

Figure 2:
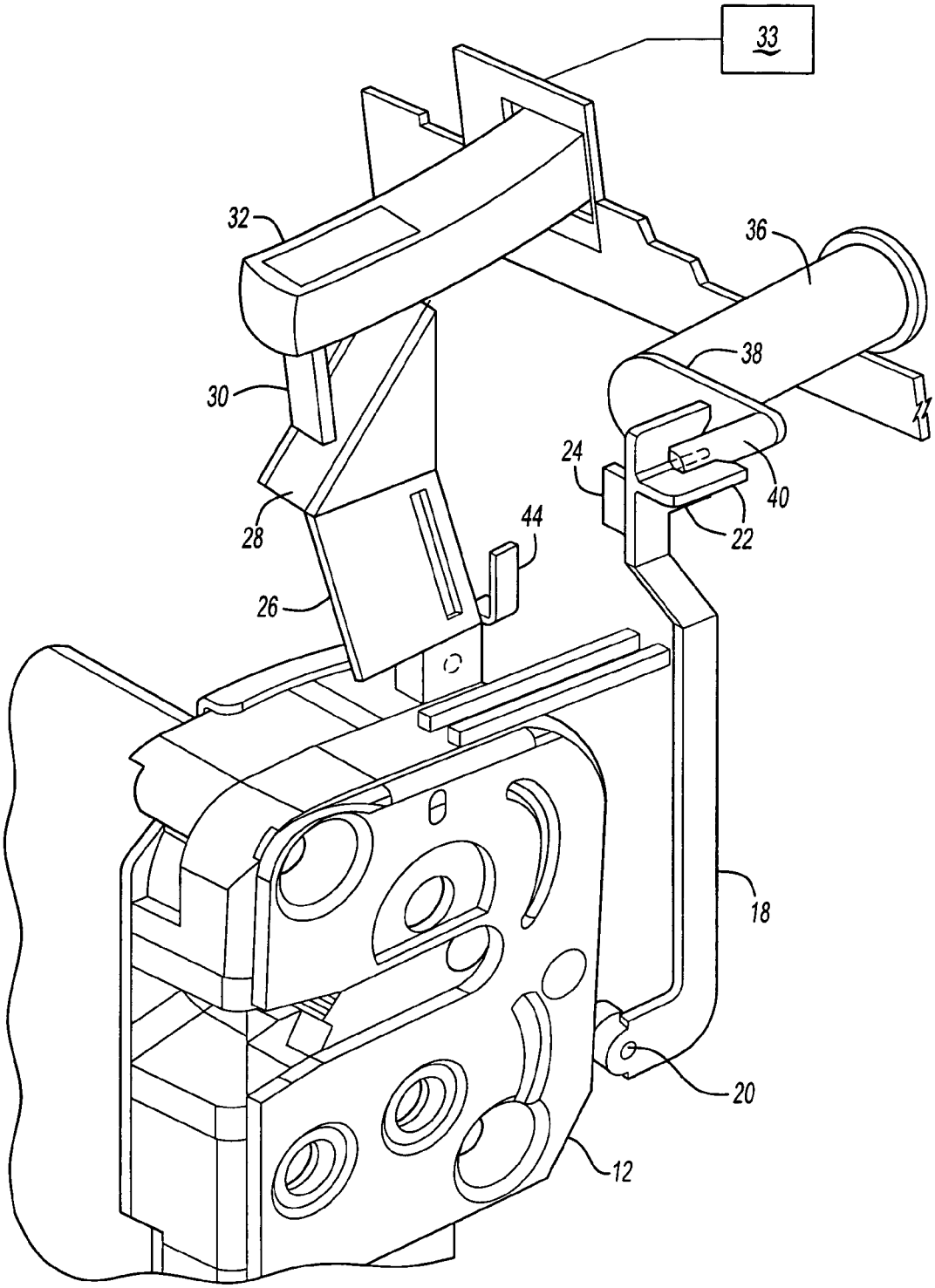
FIG. 2 is a perspective view of the latch of FIG. 1 showing the lever in a second position.
Figure 5A:
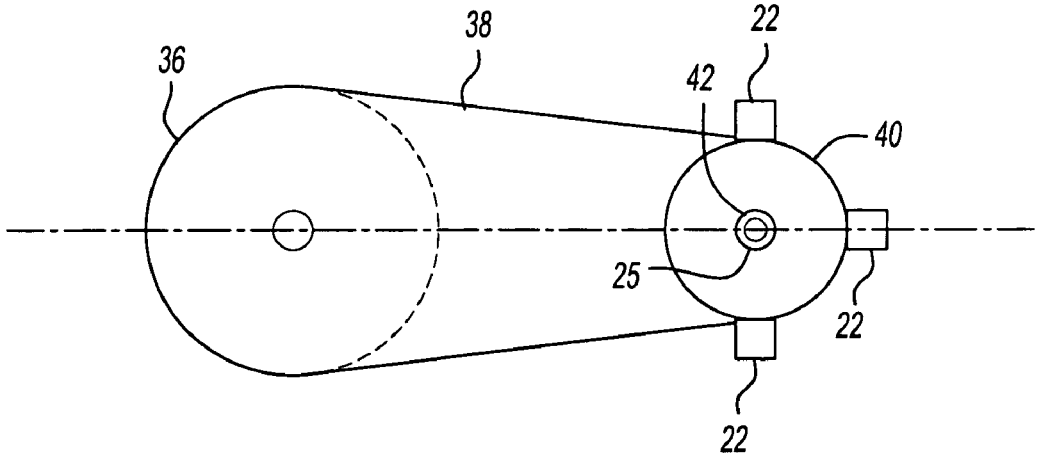
FIGS. 5A and 5B are cross-sectional views of the key barrel of FIG. 4 in first and second positions viewed along the axis Y—Y of FIG. 4.
Figure 5B:
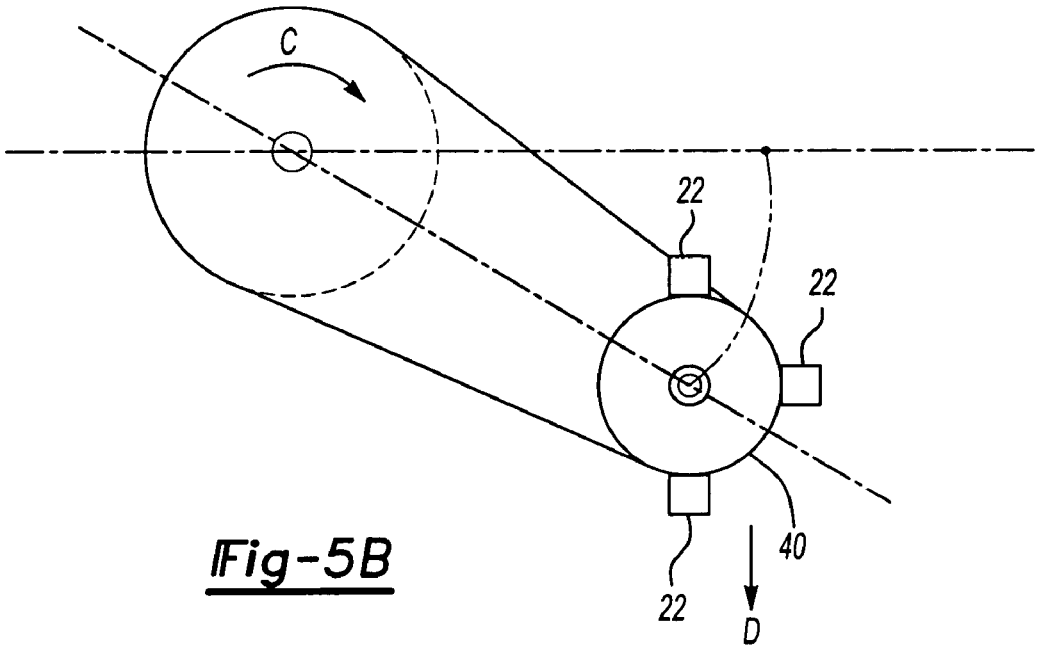

To release the key lever 18, the door assembler pulls on the door outside release handle (not shown) that has previously been installed on the door outer skin 34 in a direction indicated by arrow A. This in turn causes finger 30 of linkage 32 to ride along ramp surface 28 and cause release lever 26 to pivot in a clockwise direction as shown in FIG. 1. This pivoting motion causes lug 24 on the key lever 18 to clear projection 44 on the release lever 26 (since pivot 27 is higher up the latch than pivot 20) enabling the key lever 18 to pivot in the direction B under the influence of the resilient biasing means, and to be guided into engagement with coupling 40 by guide bars 15. The engaged position of the key lever 18 is shown in FIG. 2. The lever is maintained in this engaged position by virtue of the resilient biasing means. Referring now to FIGS. 5A and 5B, the operation of the key barrel output arm 38 is shown. FIG. 5A illustrates the rest position of the key barrel 36. When a vehicle user inserts an appropriate key (not shown) into key barrel 36 and turns the key in a clockwise direction as illustrated by arrow C in FIG. 5B, this in turn causes key barrel output arm 38 to rotate clockwise by a corresponding amount and thereby causes the upper end of key lever 18 to trace an arcuate path having a primarily vertical component to its movement. Key lever 18 is provided with some flexibility to its left and right movement as viewed in FIGS. 5A and 5B, and therefore translates the arcuate movement at its upper end to a vertical movement at its lower end where the arm connects to the latch 12. The appropriate vertical movement causes the latch to be switched between a locked and unlocked state.

Thus, it should be appreciated that the latch according to the present invention substantially simplifies the installation thereof into a vehicle door, whilst causing the connection process between the key barrel and key lever to be a simple matter of actuating the outside release handle of the door in which the latch is being installed.

It should further be appreciated that numerous changes may be made within the scope of the present invention. For example, the latch need not be offered up to the door as part of a door module, a similar principle may be employed in releasably restraining other levers or connectors between a door latch and input on the vehicle door. Suitable alternative formations may be employed for the interconnections between the key barrel and key lever and between the outside door release linkage and outside release lever.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A door latch assembly for a vehicle door, comprising:

a latch;

said latch including a latch housing;

a first lever mounted to said latch, said first lever extending from said latch housing and being movable between a first position and a second position and having a first lever formation configured for engagement with a first vehicle door input source;

a second lever mounted to said latch, said second lever extending from said latch housing and being movable between a retracted position wherein the second lever is not engaged to a second vehicle door input source and a deployed position relative to said latch housing and having the second lever formation configured for engagement with a second vehicle door input source only when in said deployed position, wherein said second lever is arranged to translate a substantially arcuate input motion of said second vehicle door input source into a substantially vertical motion of said second lever and said second lever is resiliently biased towards said deployed position; and wherein said first lever comprises a further formation configured to retain said second lever in said retracted position when said first lever is in said first position and said further formation is configured to release said second lever to move to said deployed position when said first lever is in said second position.

2. The door latch assembly according to claim 1 wherein said first lever is a door outside release lever and said door outside release lever is configured to engage said first vehicle input source.

3. The door latch assembly according to claim 2 wherein said latch further comprises a latch bolt and said door outside release lever is arranged to transmit an input to release said latch bolt of said latch.

4. The door latch assembly according to claim 2 wherein said release lever is pivotable about a fixed axis on said latch between a rest position and a release position.

5. The door latch assembly according to claim 1 wherein a guide member is provided on said latch to guide said second lever to said deployed position.

6. A door latch assembly for a vehicle door, comprising:

a latch;

said latch including a latch housing;

a first lever mounted to said latch, said first lever extending from said latch housing and being moveable between a first position and a second position and having a first lever formation configured for engagement with a first vehicle door input source;

a second lever mounted to said latch, said second lever extending from said latch housing and being moveable between a retracted position and a deployed position relative to said latch housing and having a second lever formation configured for engagement with a second vehicle door input source only when in said deployed position; and wherein said first lever comprises a catch to releasably retain said second lever in said retracted position when said first lever is in said first position and said catch is configured to release said second lever to move to said deployed position when said first lever is in said second position and wherein said second lever is a key lever and said key lever is configured to engage a key barrel when said key lever is in said deployed position.

7. A door latch assembly for a vehicle door, comprising:

a latch;

said latch including a latch housing;

a first lever mounted said latch, said first lever extending from said latch housing and being movable between a first position and a second position and having a first lever formation configured for engagement with a first vehicle door input source;

a second lever mounted to said latch, said second lever extending from said latch housing and being movable between a retracted position and a deployed position relative to said latch housing and having a second lever formation configured for engagement with a second vehicle door input source when in said deployed position, wherein said second lever is arranged to translate a substantially arcuate input motion of said second vehicle door input source into a substantially vertical motion of said second lever; and wherein said first lever comprises a further formation configured to retain said second lever in said retracted position when said first lever is in said first position and said further formation is configured to release said second lever to move to said deployed position when said first lever is in said second position, wherein said first lever is a door outside release lever and said door outside release lever is configured to engage said first vehicle input source and a catch is provided on said door outside release lever and is configured to releasably retain said second lever.

8. A method of installing a door latch in a vehicle, comprising the steps of:

providing a latch having a latch housing, a first lever mounted to the latch, the first lever extending from said latch housing and being movable between a first position and a second position and having a first lever formation to engage a first vehicle door input source;

providing a second lever mounted to the latch, the second lever extending from said latch housing and being movable between a retracted position and a deployed position relative to said latch housing and having a second lever formation to engage a second vehicle door input source when in the deployed position wherein the first lever retains the second lever in the retracted position when the first lever is in the first position and releases the second lever to move to the deployed position when the first lever is in the second position;

retaining the second lever in a retracted position through the first lever;

securing the latch relative to the first vehicle door input source and the second vehicle door input source; and actuating the first vehicle door input source to release the second input lever to move to the deployed position to thereby link the second vehicle door input source to the latch.

9. The method according to claim 8 wherein the first lever is an outside release lever and the first door input source is an outside release handle.

10. The method according to claim 8 wherein the second lever is a key lever and the second vehicle door input is a key barrel.

* * * * *